United States Patent [19]

Moore

[11] 3,965,283

[45] June 22, 1976

[54] FIBROUS SORBING MATERIALS AND PREPARATIONS THEREOF

[76] Inventor: Willard S. Moore, Rte. 1, Box 118, West River, Md. 20881

[22] Filed: Dec. 18, 1974

[21] Appl. No.: 534,007

[52] U.S. Cl. ..... 428/378; 8/52; 210/36; 210/502; 210/508; 427/301; 427/322; 427/343; 428/389; 428/394

[51] Int. Cl.[2] ..... D02G 3/00; D02G 3/44

[58] Field of Search ..... 427/301, 322, 343, 333; 428/394, 378, 389; 210/502, 508, 36; 8/52

[56] References Cited

UNITED STATES PATENTS

| | | | |
|---|---|---|---|
| 2,215,196 | 9/1940 | Schlack | 8/29 |
| 2,918,700 | 12/1959 | Hatch | 210/502 X |
| 3,058,845 | 10/1962 | Hendricks | 427/343 |
| 3,083,118 | 3/1963 | Bridgeford | 427/299 X |
| 3,382,983 | 5/1968 | Stewart | 210/502 X |
| 3,420,709 | 1/1969 | Barrett et al. | 210/502 X |
| 3,838,966 | 10/1974 | Borchas et al. | 8/52 X |

*Primary Examiner*—Harry J. Gwinnell
*Attorney, Agent, or Firm*—R. S. Sciascia; Arthur L. Branning; Thomas McDonnell

[57] ABSTRACT

Acrylic fibers coated with one or more manganese oxides; the use thereof to remove trace materials from liquids such as water; a method of preparation thereof which comprises soaking the fiber in alkali metal permanganate; and another method of preparation which comprises soaking the fiber in sequence in an alkali metal base, in manganese salt solution, and in an alkali metal base.

4 Claims, No Drawings

FIBROUS SORBING MATERIALS AND PREPARATIONS THEREOF

STATEMENT OF GOVERNMENT INTEREST

The invention described herein may be manufactured and used by or for the Government of the United States of America for governmental purposes without the payment of any royalties there on or therefore.

BACKGROUND OF THE INVENTION

This invention relates generally to sorbing materials and more particularly to fibrous sorbing materials.

Many modern research efforts, effulent waters from nuclear reactors, and the discovery of injurious effects of trace impurities in drinking water make the elimination of minute quantities of impurities in water a necessity. For example, Radium-226, a naturally occurring radioactive daughter of uranium-238, presents a potential health hazard when dissolved in ground waters. The body metabolizes radium and calcium similarly; thus, if radium is available to the bloodstream, it will concentrate in the bones. Radioactive decay of radium-226 within the bones exposes the skeleton to highly ionizing, short-range alpha particles as well as more penetrating beta and gamma radiation from radium daughters. The most immediate effect of this radiation is to increase the chances of developing osteosarcoma and other cancers. Although the exact relationship between low level radium exposure and cancer risk is not known, there is probably no safe level of human exposure to radium. The drinking water standards published by the U.S. Public Health Service recommend a level not to exceed 3 picocuries (pCi) per liter (6.66 disintegrations per minute (dpm) per liter).

Removal of trace constituents from large volumes of liquids requires an extremely efficient means. The techniques generally used may be classified as ion exchange, precipitation, and solvent extraction.

Conventional ion exchange techniques employ an activated particulate through which the liquid is slowly percolated. Depending on the conditions various components may be removed; however, the particulate materials have a low surface area per unit mass and must be tightly packed to be effective. The materials do not generally allow removal to be conducted at high flow rates. They are also generally expensive and may suffer radiation damage. Another ion exchange technique is the use of an activeated fiber, e.g., acrylic fiber impregnated with iron hydroxide. Other examples of activated fibers are phosphorus cotton fibers and ferric oxide cotton fibers. These fibers have been shown to be inefficient for radium retrieval from both fresh and sea water.

Precipitation involves the chemical precipitation of either the constituent of interest or of a scavenger which removes the component of interest. Precipitation cannot be done as a flow process without a continuous flow centrifuge or filtration apparatus. These techniques are objectionable for their inconvenience, cost, and inefficiency.

Solvent extraction is based on the affinity of various components for organic liquids or solutions which are water insoluble and immiscible. Under controlled conditions, components of interest may be extracted into the organic phase which may then be separated from the aqueous phase by flotation or centrifugation. This process is usually not as efficient in terms of the percent removal as the ion exchange or precipitation processes.

Methods usually used to specifically purify drinking water parallel the previously discussed techniques. The major difference is their lower efficiency and often these techniques are designed to eliminate only one type of impurity, e.g., mercury or germs. As a result, these techniques are being proven to be inadequate to safeguard public health by findings of medical research that even the smallest amounts of certain contaminants in drinking water have an adverse effect on the health of humans. Further these techniques are objectionable from one or more other considerations, such as cost, speed, or durability.

It is therefore an object of this invention to provide a means and method for purifying liquids.

Another object of this invention is to provide a means and method for purifying water.

Another object is to provide an efficient means and method for removing trace elements from water.

Another object is to provide a simple, cheap, and versatile means and method for removing trace elements and other impurities from water.

And another object is to provide a filter for water which is durable and require infrequent regeneration.

A further object is to provide a material removing means which can process large volumes of water quickly and continuously.

A still further object is to provide a filtering material which can be easily incorporated in a filter which can be added to an effulent water conduit of a nuclear reactor or a factory.

And a still further object of this invention is to provide a filtering material which can be easily incorporated in samples to be towed by a ship.

Also an object of the invention is to provide a method and means for purifying water which does not require any special water preparation or added filtering aid.

And a further object is to provide a material removing means which has little back up pressure and no channeling.

And still another object is to provide methods of placing a manganese oxide coating on acrylic fibers.

These and other objects are achieved through coating acrylic fibers with manganese oxides so strongly and heavily and without serious damage to the fiber that the resulting materials can continuously remove metals and radioisotopes even from water in which the impurity concentration may be as low as 1 ppm.

DETAILED DESCRIPTION OF THE INVENTION

The terms, "fiber" and "acrylic resin" are herein used in their usual sense. Thus fiber means a fine threadlike piece or a filament and acrylic resin refers to the group of thermoplastic resins formed by polymerizing the esters or amides of acrylic acid.

The mechanism by which the treated fibers of this invention purify water is by a combination of surface adsorption and ion exchange. The fibers act as a matrix into which manganese oxides are incorporated and through which liquids such as water may be circulated. Important to the success of this invention in removing trace constituents from water is the great strength of the bond between the manganese oxides and the acrylic fiber. This strength is due to a chemical bonding between the coating and fiber.

A surprising aspect of this invention is the heavy loading of acrylic fibers with manganese oxide without any appreciable damage to the fiber. Rayon and cellulose were similarly treated, but these fibers became brittle and broken. Hence, such materials are not too practical for purifying water by themselves. An additional material would be required to hold the weakened and damaged fibers together.

Any type of acrylic fiber may be used. The characteristices sought in a fiber is strength and cohesiveness.

The fiber may be coated in any manner which does not seriously damage the fiber and which provides a sufficient locking of manganese oxides to the fiber. The two methods developed in this invention are herein given. All of the solutions used in the two preparations are aqueous.

By the first method acrylic fiber is converted to a cation exchange type resin by treatment with an alkali metal base and a soluble manganese salt which is capable of producing $Mn^{+2}$ in solution. First the fiber is immersed in a solution of an alkali metal base such as NaOH or KOH with NaOH preferred at a concentration from 4N to 7N with 5N to 6N preferred, at a temperature from about 80°C to about 110°C with 80°C–90°C preferred. Roughly, the speed of reaction doubles for each 10°C increase. When the fiber begins to develope an orange-red color, the reaction is stopped by squeezing the excess solution from the fiber. The treated fiber is then immersed in a solution of a soluble manganese salt capable of producing $Mn^{+2}$ in solution, preferably $MnCl_2$ or $Mn(NO_3)_2$ at a concentration from about 60% to 100% saturation, preferably from 75% to 90% saturation at a temperature from about 20°C to about 70°C with 30°C to 40°C preferred until the fiber is saturated. It should be noted that the manganese salt solution is maintained at a pH from about 1 to about 2 with an acid such as HCl or $HNO_3$ in order to prevent the precipitation of manganese. The soaked fiber is now drained and immersed in a solution of an alkali metal base, preferably NaOH at a concentration from about 3N to about 7N with 5.5N to 6.5N preferred at a temperature from about 20°C to about 70°C with a temperature from 25°C to 30°C preferred in order to precipitate $Mn(OH)_2$ onto the fiber. The precipitation occurs quickly so by the time the fiber becomes soaked, it may be removed.

After the fiber is removed and drained, it is separated (fluffed) and left exposed to the air to oxidize the $Mn(OH)_2$ to a mixture of hydrous MnO, $MnO_2$, and MnOOH. The oxide composition was determined by use of a stability field diagram. As the $Mn(OH)_2$ oxidizes, the fiber turns from a pale grey to black. After the fiber has completely blackened, it is ready for use.

The second method is simpler. The acrylic fiber is immersed in a alkali metal permanganate solution preferably $KMnO_4$ at a concentration from about 0.2N to about 0.7N with a temperature from about 60°C to about 80°C with a range from 70°C to 80°C preferred for a period from about 8 to about 15 minutes preferably from 10 to 12 minutes. The reaction is exothermic and therefore care must be taken to ensure that the temperature does not exceed the above temperature limit. The fiber is removed from the solution and washed with water or a similar liquid. After the excess solution is removed from the fiber by squeezing, wringing, or similar techniques it is ready for use. The oxide coating produced by this method comprises $MnO_2$. This determination was made by a stability field diagram.

Temperature and concentration increase the speed of reaction. Thus the slower combinations of temperature and concentration would require a reaction time up to 90 minutes in order to obtain a practical loading of the fiber. Basically the fiber is immersed long enough to obtain the desired loading.

With either method, a loading as high as 14 to 16 gm per 100 gm is sufficient to provide a practical and effective filter.

By way of illustration the following two example preparations are given. These examples are not intended to limit, in any manner the scope of the present invention or the claims to follow.

EXAMPLE I

Five hundred grams of acrylic fiber (Monsanto "Acrilan", 3.0 denier, type B-16) were covered with 2 liters of 6N NaOH solution at 80°–90°C; when the fiber began to develop an orange-red color, the reaction was stopped by squeezing the excess NaOH from the fiber. The treated fiber was immersed in 1 liter of 5N $MnCl_2$ at 30°–40°C. The $MnCl_2$ solution was maintained at pH = 1–2 with HCl to prevent precipitation of the manganese. The soaked fiber was drained and immersed in 1 liter of 6N NaOH at 25°C to precipitate $Mn(OH)_2$. The fiber was then separated (fluffed) and left exposed to the air to oxidize the $Mn(OH)_2$ to a mixture of hydrated MnO, $MnO_2$ and MnOOH. When the fiber had completely blackened, it was packed in polyethylene bags for later use.

EXAMPLE II

Five hundred grams of acrylic fiber (Monsanto "Acrilan", 3.0 denier, type B-16) were immersed into a 0.5N potassium permanganate solution at 70° to 80°C for 10 minutes. After removal from the permanganate solution, the fiber was washed with water and then drained of excess moisture by a wringer.

To remove the collected material from the fiber, any standard retrieval process would suffice. For example, to remove radium from the Mn-treated fiber, the sample (5–200 grams) is covered by 6–8N HCl, and boiled for 1 hour. This procedure converts MnO and $MnO_2$ to $MnCl_4$, which decomposes to $MnCl_2$ and $Cl_2$, leaving the solution clear and the fiber literally bleached white. About 1 liter of acid is required for 100 grams of fiber. A better method and one which allows the fiber to be reused at least five times comprises placing the used fiber in a volume of 1–2N $HNO_3$ at least equal to four times the volume of fiber.

To demonstrate the strength of the bond between the oxide coating and the acrylic fiber, a quantity of fiber coated by the first method was towed for 8 hours behind a ship traveling at a speed of 18 km/hr with an oxide loss of only 30%. This strong bond permits the use of fibrous material of this invention to be used in very cold and high pressure environments such as those found 3 to 4 kilometers below the surface of the ocean. In an experiment described in Moore, W. S., et al. *Extraction of Radium from Natural Waters Using Manganese-Impregnated Acrylic Fibers*. In J. Geophy. Res. 78, p. 8880–6. Dec. 20, 1973, the depth profile of $^{226}Ra$ between 3200 and 3740 meter below the surface of the ocean was determined within a 5% margin of error by using a coated acrylic fiber prepared by Method I.

The experimental results and conditions summarized in Table I were obtained with the coated acrylic fiber of Example I except for Sample 6. That sample was a $Fe(OH)_3$-acrylic fiber prepared according to the method disclosed in Krishnaswami, S. et al., *Silicon, Radium, Thorium and Lean in Seawater: In-site Extraction by Synthetic Fiber.* In Earth Planet Sci. Letter, 16, pp. 84–90, 1972, removed only 11% of the radium in a duplicated sample. The results are summarized in Table I. The experiment comprised passing samples of seawater through 8-cm columns containing a quantity of filtering fiber.

Table I

| Sample | Fiber | Conditions | $^{226}Ra$ % Removal |
|---|---|---|---|
| 1 | 5g Mn | single pass, 20 liters, 100 ml/min | 95 ± 5 |
| 2 | 5g Mn | single pass, 11 liters, 100 ml/min | 93 ± 5 |
| 3 | 10g Mn | two passes, 20 liters, 100 ml/min | 95 ± 5 |
| 4 | 10g Mn | two passes, 20 liters, 100 ml/min | 95 ± 5 |
| 5 | 80g Mn | continuous circulation of 700 liters at 10 l/min for 300 min | 90 ± 5 |
| 6 | 80g Fe | continuous circulation of 700 liters at 10 l/min for 300 min | 11 ± 1 |
| 7 | 40g Mn | first pass of 170 liters at 10 l/min | 56 ± 4 |
| 8 | 40g Mn | second pass of 170 liters at 10 l/min | 23 ± 2 |
| 9 | 40g Mn | third pass of 170 liters at 10 l/min | 12 ± 1 |

As can be seen from the above result, the fibers of this invention have an exceptional filtering proficiency and represent a radical improvement over the $Fe(OH)_3$ coated acrylic fiber which is a highly regarded adsorption material.

To demonstrate the filtering proficiency of the fibrous materials of this invention with a heavily contaminated liquid, the above experiment was repeated with 20-liter seawater sample spiked with 50 dpm $^{226}Ra$. The flow rate was 100 ml/min. More than 95% of the radium was retained by one pass, and an additional 3% was removed by a second pass through fresh fiber. The spiked seawater had less than 0.5 dpm $^{226}Ra$ after two filtrations through the fiber.

The proficiency of the manganese oxide fibers of this invention in extracting trace elements from seawater surfaces is demonstrated by the following experiment which compared samples prepared in Example I with a $Fe(OH)_3$-acrylic fiber prepared as before and with an untreated acrylic fiber.

The experiment is reported in greater detail in Moore, W. S., et al., *Extraction of Radium from Natural Waters Using Manganese-Impregnated Acrylic Fibers.* In J. of Geophy. Res. 78(36): p. 8880–8886., Dec. 20, 1973.

Large volumes of surface waters were sampled by towing the fiber. Between 100 and 500 grams of fiber (on a dry weight, untreated basis) were fluffed and packed into a PVC cylinder 23 cm long and 22 cm in diameter. The ends were closed with PVC sheets, each having 85 holes 1 cm in diameter. A sheet of 18-mesh fiberglass screen was sealed between the covers and the cylinder to prevent washout of the fiber.

The sampler was towed at approximately 18 km/hr 20 meters behind the ship. In calm seas it sampled from about 500 cm below the surface; however, in rough seas and especially in following seas it often sank to several meters and broke surface. Even then the sampler has little tendency to skim over the surface.

The results are summarized in Table II:

Table II

| Sample | Fiber Type | Tow time, min | $^{226}Ra$ + dpm/100g fiber |
|---|---|---|---|
| 1 | Mn | 300 | 220 |
| 2 | $Fe(OH)_3$ | 300 | 5.6 |
| 3 | Mn | 85 | 156 |
| 4 | Mn | 295 | 305 |
| 5 | Mn | 320 | 250 |
| 6 | Mn | 85 | 103 |
| 7 | Mn | 510 | 137 |
| 8 | Mn | 300 | 181 |
| 9 | Mn | 310 | 152 |
| 10 | untreated | 285 | 0.64 |
| 11 | Mn | 0 | 0.12 |

Again the results show that the fibers of this invention provide highly efficient filters and represent a marked improvement over the $Fe(OH)_3$-acrylic fiber.

Fibers prepared by the second method were shown by the next two experiments to be significantly better than fibers prepared by the first method in removing $^{226}Ra$. A 50 gm sample of each type of fiber was towed at speeds of 2–3 km/hr for 45 minutes on the surface of seawater in an apparatus similar to the apparatus hereinbefore described. In the second experiment a 10 gm sample of each type of fiber was immersed in seawater for 14 hours. The results of both experiments are summarized in Table III. The type number corresponds to the method of preparation.

Table III

| | Fiber type | dpm $Ra^{226}$ |
|---|---|---|
| Experiment I | | |
| | 1 | 107 |
| | 2 | 194 |
| Experiment II | 1 | 17 |
| | 2 | 25 |

The manganese oxide coated acrylic fiber prepared by the process of Example I has been shown to provide a filter efficient enough to purify fresh water unsafe for drinking sufficiently to pass the U.S. Public Health Service limits.

Commercial grade uranium deposits in south Texas have been mined since the late 1950's. A number of wells in the south Texas area have been surveyed and were found to expose persons drinking the water to radium levels above the U.S. Public Health Service Standard. One of these wells, referred to as well No. 1 was tested. This well has a Ra-226 concentration of 110 pCi/liter, the second highest level measured in recent surveys of this area. Small deposits of uranium are known to occur within 300 meters of this well; a high-grade uranium deposit is being mined within 8 km of this well. These localized ore bodies are believed to be the sources of radium found in the well waters of south Texas.

About 40 grams of fiber were packed in a water-filtering column. Two such columns were connected in series with a sampling valve attached to the system between well No. 1 and column 1 and between columns 1 and 2. The flow was monitored with a water meter attached downstream of column 2. As water passed through the system, samples were drawn from each valve and stored for radium-226 determinations using the radon-222 emanation technique.

Initially the flow rate decreased slightly due to packing of the fiber. By adjusting the water pressure we attained a rather steady flow through the system. The experiment was terminated after 2650 liters had been processed.

The results of the experiment proved that radium could effectively and inexpensively be removed from this well water. Radium removal from this highly contaminated well by two fiber columns was essentially complete for 1,300 liters. After 1,300 liters had passed through the system, the column 2 effulent was 3 pCi/-liter, the Public Health Service recommended drinking water limit. After 2650 liters of water had been processed, the outflow from column 2 still had less than 10% of the Ra-226 concentration of water entering the system. Thus one kg of fiber would ring the radium level of more than 10,000 liters of the water from this well to within the U.S. Public Health Service limit. This would be adequate drinking water for a family of four for three years. Since most wells in the area have Ra-226 levels much below the tested well, the 10,000 liter figure is a minimum.

The following series of experiments demonstrate the utility of the present invention in removing metals other than radium from water. Solutions of 100 ppm of $Ba^{+2}$, $Cu^{+2}$, $Co^{+2}$, $Zn^{+2}$, and $Ca^{+2}$ in distilled water were prepared. Each solution was passed through a 1 gm sample of the fiber prepared in Example II. The solution was passed through the sample until the sorbing action stopped. The fiber was then washed with distilled water at a pH of 6 until the washings were free of the element of interest. Thus, the remaining amount of metal was affixed to the fiber. The fiber was then treated with 2N $HNO_3$ to remove the affixed metal from the fiber. Table IV summarizes the amounts of metal obtained for each solution passing through a one gram sample of fiber. The weight of the fiber like all of the weights of fiber recited herein is a dry weight.

Table IV

| Solution | Recovery [=] mg |
|---|---|
| $Ba^{2+}$ | 100 |
| $Cu^{2+}$ | 30 |
| $Zn^{2+}$ | 12 |
| $Co^{2+}$ | 13 |
| $Ca^{2+}$ | 2 |

In summary the manganese oxide coated acrylic fibers of this invention provide a strong matrix of manganese oxide tightly bound to fiber strands, thus allowing water to be passed through this large surface area material at a high flow rate. Some of the applications possible with these fibers are concentration of trace metal from seawater, removal of harmful metals from drinking water, removal of pollutants from waste waters, and concentration of valuable trace metals from dilute solution.

Obviously many modifications and variations of the present invention are possible in light of the above teachings. It is therefore to be understood that, within the scope of the appended claims, the invention may be practiced otherwise than as specifically described.

What is claimed and desired to be secured by letters patent of the United States is:

1. A method of preparing a manganese oxide coated acrylic fiber which comprises:

immersing acrylic fiber in a solution of an alkali metal base at a concentration from about 4N to about 7N at a temperature from about 80°C to about 110°C until the fiber obtains an orange-red color;

removing said fiber from said solution;

removing excess solution from said fiber;

immersing said fiber in a solution of a $Mn^{+2}$ with a pH from 1 to 2 at a concentration from about 60% to 100% saturation at a temperature from about 30°C to about 40°C until the fiber is saturated;

removing said fiber from said solution;

removing excess solution from said fiber;

immersing said fiber in a solution of an alkali metal base at a concentration from about 3N to about 7N at a temperature from about 20°C to about 70°C;

removing said fiber from solution;

removing excess solution from said fiber; and exposing said fiber to air until a blackish color is obtained.

2. A method of preparing a manganese oxide coated acrylic fiber which comprises:

immersing acrylic fiber in a solution of NaOH solution at a concentration from 5N to 6N at a temperature from 80°C to 90°C until the fiber obtains an orange-red color;

removing said fiber from said solution;

removing excess solution from said fiber;

immersing said fiber in a solution of manganese chloride with a pH from 1 to 2 at a concentration from 75% to 90% saturation at a temperature from 30°C to 40°C until the fiber is saturated;

removing said fiber from said solution;

removing excess solution from said fiber;

immersing said fiber in a NaOH solution at a concentration from 5.5N to 6.5N at a temperature from 25°C to 30°C;

removing said fiber from said solution;

removing excess solution from said fiber; and exposing said fiber to air until a blackish color is obtained.

3. The product of claim 1.

4. The product of claim 2.

* * * * *